United States Patent [19]

Husted

[11] 4,061,340

[45] Dec. 6, 1977

[54] GOLF SWING AID

[76] Inventor: Allen Husted, 12865 Main St., Garden Grove, Calif. 92640

[21] Appl. No.: 704,763

[22] Filed: July 13, 1976

[51] Int. Cl.[2] ..... A63B 69/36

[52] U.S. Cl. ..... 273/189 R; 128/134

[58] Field of Search ..... 128/134, 94; 273/189 R, 273/189 A, 183 B; 35/29 A

[56] References Cited

U.S. PATENT DOCUMENTS

| | | | |
|---|---|---|---|
| 594,572 | 11/1897 | Slavik | 128/94 |
| 2,652,050 | 9/1953 | Schoeller | 128/94 |

*Primary Examiner*—George J. Marlo

[57] ABSTRACT

A golf swing aid is provided for controlling the position of the swing arm of the golfer which comprises a removable belt surrounding the body of the golfer attached to a plastic horseshoe-type member. The swing arm of the golfer is contained within such horseshoe member so that the arm cannot extend laterally from the body.

4 Claims, 4 Drawing Figures

GOLF SWING AID

INTRODUCTION

This invention relates to a golf swing aid utilized by golfers to improve their golf stroke, particularly in drive shots.

It is fundamental in the art of golfing that the "swing arm" or right arm for right-hand golfers and the left arm for left-hand golfers should be maintained close to the body. For purposes herein "arm" shall refer only to the portion of the arm above the elbow. Of course, the area below the elbow extends some distance from the body in that the hand is on the golf club. The upper arm, however, should be maintained close to the body during the backward swing stroke. During the back swing, the right elbow should be maintained close to the right side of the body.

Many beginners or those who have not been properly trained in golfing, tend to permit their swing arm to fly loose from the body and extend laterally from the body. This results in a rather chaotic and ineffective back swing and a poor stroke in general.

It is an object of the present invention to improve the golf swing by providing a simple device to maintain the upper arm close to the body during the golf stroke. Further and other objects of the invention will be apparent from the following descriptions.

Figure 1:
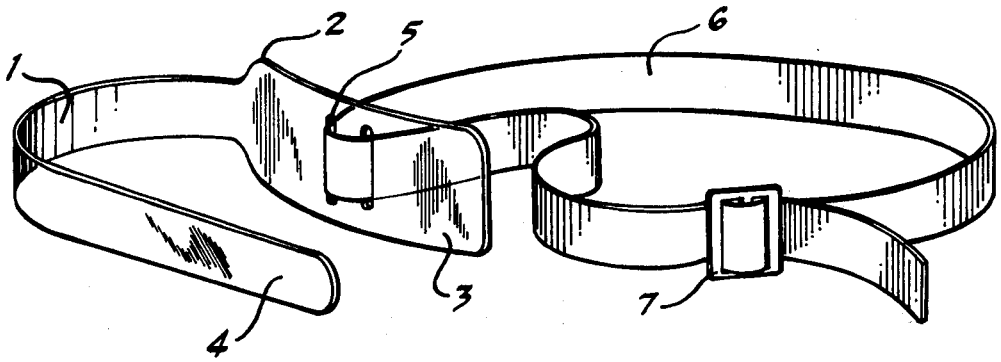
FIG. 1 shows the device of the invention in detail in a prospective view.

Referring to FIG. 1, it can be seen that the device comprises a generally rigid horseshoe-type member 1. Such member is preferably comprised of plastic. Such plastic can be the molded polyethelene or other similar plastic. The member is generally of a horseshoe configuration. This has the advantage that the golfer can simply move his arm out of the front and open portion of the horseshoe when he is not utilizing the device and can rotate the belt about his body so that the horseshoe may, for example, be in his back area when he is not utilizing the device during the golf swing. The back portion of the horseshoe member prevents his arm from moving backwards without a correspondent movement of his body. The outward side portion 4 portion of the horseshoe prevents the arm from moving laterally from the body.

Figure 2:
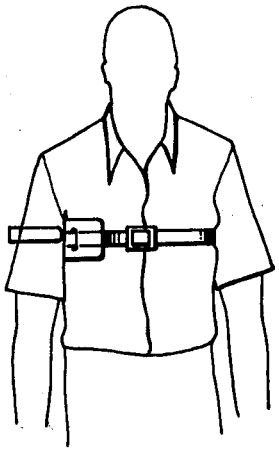
FIG. 2 is a front view showing the device attached to the body of the golfer.

The inner portion 3 of the horseshoe member contains several slots 5 for attachment to the belt or strap 6. A buckle 7 is provided with the belt. The belt can be attached to the body as shown in FIG. 2 and removed from the body utilizing the buckle. The belt can also be rotated so that the user need not remove the entire device when it is not desired to use the invention and yet maintain the device on his body for convenient reference for the swing.

The horseshoe-type loop or device can be of any general shape. Obviously, the width of the horseshoe is a distance just larger than the width of the upper arm. The length of the horseshoe is that just larger than the width of the upper arm. The width of the particular sides and back portion of the horseshoe is not particularly significant but must be that to maintain proper strength and is generally 2 to 6 inches. When utilized, the open or front portion of the horseshoe faces frontwards from the user so that the back and closed portion of the horseshoe fits on the back portion of the swing arm.

Figure 3:
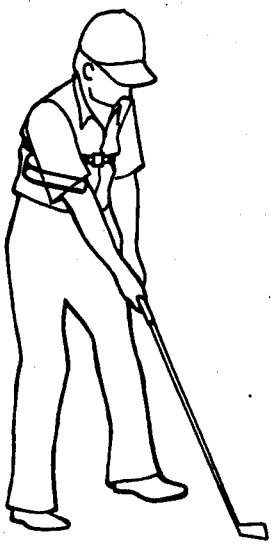
FIG. 3 shows the device in place on the golfer at the beginning of the golf stroke.
Figure 4:
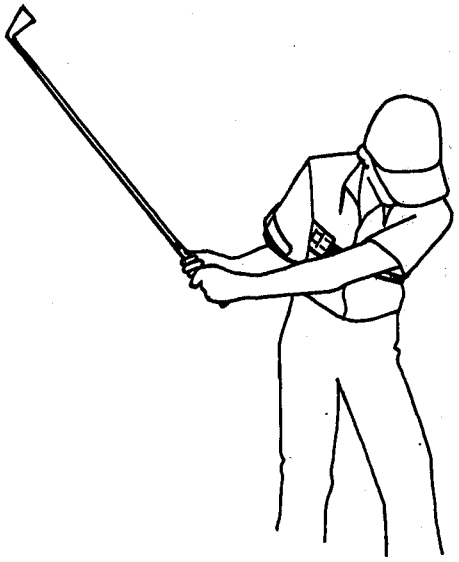
FIG. 4 shows the position of the device at about the termination of the back swing.

As shown in FIG. 3, the horseshoe member is generally rigid with the body. As the golfer swings backwards as shown in FIG. 4, the back portion of the horseshoe prevents the arm from moving backwards unless there is a correspondent backward movement of the body. Likewise, the outward side portion of the horseshoe member prevents the arm from moving laterally from the body thus insuring a smooth, sound and forceful backswing. The device enables the user to properly cock the golf club by rotation of the elbow and the arm downwards from the elbow is free to move in any direction. This makes for sufficient flexibility in the back swing.

When not in operation, as stated above, the user can simply rotate the belt about his body so that the horseshoe member does not interfer with his arm. The user, therefore, does not need to unstrap the entire device while not in his stroke. Alternately, the user can simply bring his arm out of the open portion of the horseshoe when he is not swinging. Thus, the cumbersome operation of unstrapping the arm and body is eliminated. This feature, in itself, is a substantial improvement in the art.

I claim:

1. A golf aid device for controlling the position of the upper portion of the swing arm during a golf swing comprising:
   a. A removable belt suited to surround the body of the golfer and which defines a generally horizontal plane about such body;
   b. A generally rigid and horseshoe-type member which is adapted to fit about the portion of the golf swing arm above the elbow; and
   c. Means for attaching said member to said belt so that said member surrounds the swing arm and prevents such arm from extending backwardly or laterally from the body during the backward swing stroke; and so that such member is maintained in such horizontal plane.

2. The device of claim 1 wherein said horseshoe-type member is plastic.

3. The device of claim 1 wherein said belt is attached to said member through two slots in said member.

4. The device of claim 1 wherein said belt contains a hook held in a horizontal plane.

* * * * *